US005169689A

United States Patent [19]

Thompson et al.

[11] Patent Number: 5,169,689

[45] Date of Patent: Dec. 8, 1992

[54] METHOD OF PRODUCING THERMAL BARRIER COATINGS ON A SUBSTRATE

[75] Inventors: Robert A. Thompson, Quaker Street, N.Y.; Bhunpendra K. Gupta, Cincinnati, Ohio

[73] Assignee: General Electric Company, Schenectady, N.Y.

[21] Appl. No.: 769,688

[22] Filed: Oct. 2, 1991

[51] Int. Cl.[5] ..... B05D 3/02

[52] U.S. Cl. ..... 427/372.2; 427/402; 427/419.1; 427/421

[58] Field of Search ..... 427/419.1, 372.2, 402, 427/421

*Primary Examiner*—Bernard Pianalto

*Attorney, Agent, or Firm*—James R. McDaniel

[57] ABSTRACT

This invention relates to barrier coatings and the method for making the same. In particular, low stress, thick thermal barrier coatings are relieved by providing a compliant ceramic layer between the substrate and a hard erosion resistant top coat layer.

4 Claims, 1 Drawing Sheet

METHOD OF PRODUCING THERMAL BARRIER COATINGS ON A SUBSTRATE

BACKGROUND OF THE INVENTION

1. Field of the Invention

This invention relates to barrier coatings and the method for making the same. In particular, low stress, thick thermal barrier coatings are disclosed along with the method for making the coatings such that the thermal stresses in the coated substrate are relieved by providing a compliant ceramic layer between the substrate and a hard erosion resistant top coat layer.

2. Description of the Related Art

The drive for improved gas turbine engine performance is pushing hot section operating temperatures higher, typically, as high as 1600° F. These temperatures have reached the point where metal alloys break down and means for protecting the metal are needed. In one commonly used method, the injection of cooling air from the compressor is injected into the turbine. However, the cooling air has a very negative effect on performance and efficiency. Therefore, alternative, ceramic thermal barrier coatings (TBC's) have evolved. Ceramics are chemically inert and remain strong at high temperatures. They also have the advantage of low thermal conductivity and, therefore, very effectively shield the metallic substrate layer.

In a conventional TBC's, the ceramic layer is bonded to a metal substrate by uniform application of a conventional plasma spray process. The difficulty with the uniform bonded ceramic layer, however, is that its thermal expansion coefficient is smaller than the substrate's. Differential strain across the layers during cool down following spraying or during nonequilibrium thermal excursions puts the ceramic into residual compression. This compressive stress produces edge shear which is greatest near the ceramic/substrate interface. If sufficient, the shear can cause in-plane spalling just above the metal/bondcoat layer corners of the sprayed parts where it is concentrated.

The interfacial shear stress increases with the elastic modulus of the ceramic layer as does the ceramic's resistance to erosion by particles passing through the engine. Thus, setting the spray process for a more erosion resistant ceramic layer may increase the stresses which cause spallation.

It is apparent from the above that there exists a need in the art for a TBC which relieves thermal stresses by providing a compliant ceramic layer between the substrate and a hard erosion resistant top coat layer. In this manner, the intermediate ceramic layer will be able to provide good thermal resistance while having a low effective modulus to longitudinal strains so as to reduce thermal stress in the turbine. It is a purpose of this invention to fulfill this and other needs in the art in a manner more apparent to the skilled artisan once given the following disclosure.

SUMMARY OF THE INVENTION

Generally speaking, this invention fulfills these needs by providing a method for producing thermal barrier coatings on a substrate having first and second sides, said method comprised of the steps of: coating said second side of said substrate with a low density thermal barrier coating such that said coating has first and second sides and said first side of said coating is adjacent said second side of said substrate; modifying said coating such that cracks form in said coating substantially perpendicular to said first and second sides of said coating; and coating said second side of said low density coating with a high density thermal barrier coating such that said high density coating has first and second sides and said first side of said high density coating is adjacent said second side of said low density coating.

In certain preferred embodiments, the low density and high density thermal barrier coatings are applied by selective plasma spraying layering techniques. Also, the low density coating is sprayed at room temperature (~70° F.) and the high density coating is sprayed at 800° F. Finally, the low density coating is heated up to 800° F. to produce the cracks in the low density coating.

In another further preferred embodiment, the thermal stresses in the substrate, such as a turbine shroud, are relieved by providing a compliant ceramic layer between the substrate and the hard erosion resistant top coat layer.

The preferred thick, thermal barrier coatings, according to this invention, offer the following advantages: reduced stresses; good thermal resistance; excellent durability; easy application to the substrate; and good economy. In fact, in may of the preferred embodiments, these factors of stresses, resistance, and durability are optimized to an extent considerably higher than heretofore achieved in prior, known TBC's.

BRIEF DESCRIPTION OF THE INVENTION

The above and other features of the present invention which will become more apparent as the description proceeds are best understood by considering the following detailed description in conjunction with the accompanying drawings wherein like characters represent like parts throughout the several views and in which.

DETAILED DESCRIPTION OF THE INVENTION

Figure 1:
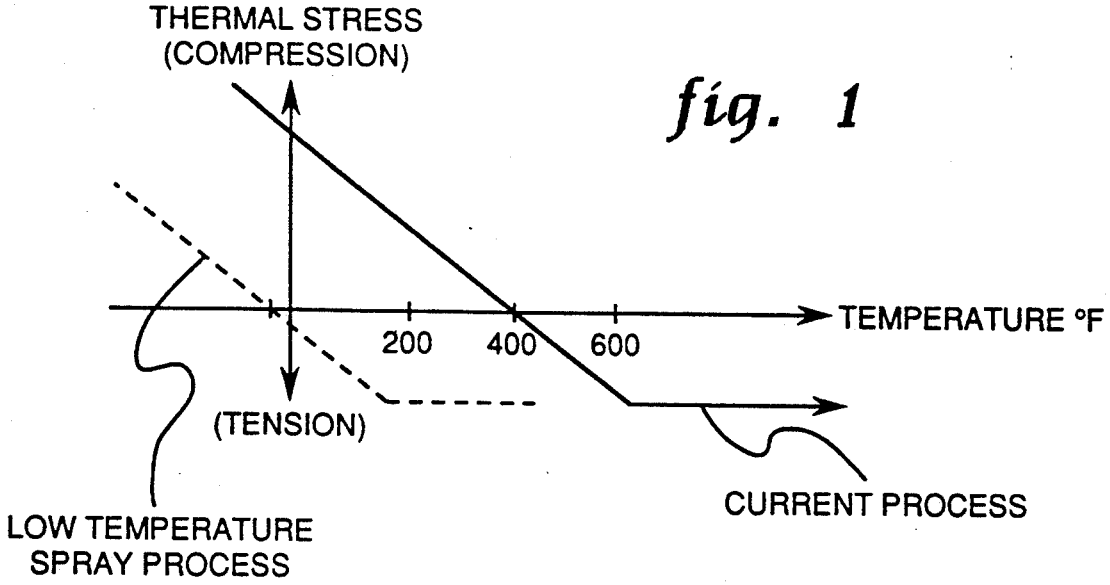
FIG. 1 is a graphical representation of stress in the ceramic layer versus temperature for a typical current process and for the low temperature process, according to the present invention.

With reference first to FIG. 1, FIG. 1 shows stress in the ceramic versus temperature for current and low temperature spraying conditions. Compressive stress is positive, tensile stress negative, and the zero stress state occurs roughly at the temperature of the metal substrate at the time it was sprayed. This state occurs at about 400 degrees-F. for the prior, known process. As the part temperature is elevated above the stress free temperature, tension builds until the tensile limit of the ceramic is reached after which further temperature increase does not increase stress. Instead, thermal strain is relieved by tensile or mudflat cracking in the ceramic layer. Mudflat cracks run normal to the surface of the substrate, for example, a shroud used in turbine engines.

Figure 2:
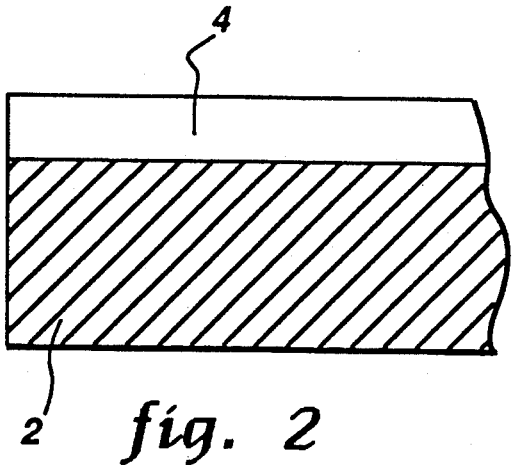
FIG. 2 is a schematic drawing of the substrate coated with a low density TBC, according to the present invention.

This invention is based on this cracking behavior. That is, in this invention, following conventional application by plasma spraying of the bond coat layer 4 (FIG. 2) to the top of metal substrate 2, an approximately 0.035 inch layer of low density zirconia ceramic is sprayed while maintaining a low substrate temperature, preferably, at room temperature (~70° F.). The part is, therefore, stress free at low temperature (the dashed line of FIG. 1).

Figure 3:
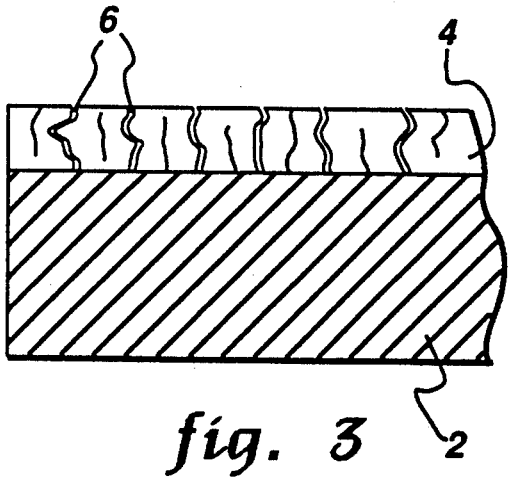
FIG. 3 is a schematic drawing of the low density TBC having cracks, according to the present invention.
Figure 4:
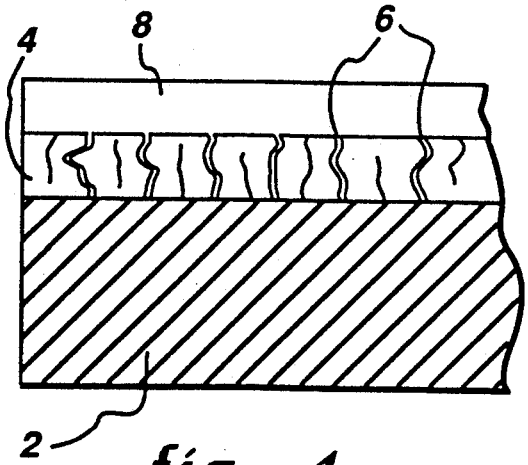
FIG. 4 is a schematic drawing of the high density TBC layer applied to the low density TBC and the substrate, according to the present invention.

Next, the spraying parameters are set to yield a high density, hard ceramic layer. Substrate 2 and layer 4 are then heated to about ½ their service temperature, preferably, to a temperature of about 800 degrees-F. When heated, the ceramic layer 4 is forced to accommodate large tensile strains due to expansion of the substrate 2. These tensile strains are relieved by mudflat cracks 6 (FIG. 3). The resulting hair brush structure can be enhanced by other strain inducing techniques such as pre-stressing substrate 2 in compression while spraying the 35 mil layer 4 and then releasing the compression. In any case, while at the elevated temperature, mudflat cracks 6 are over sprayed by the hard ceramic layer 8, preferably, of high density zirconia until layer 8 is approximately 15 mils thick (FIG. 4).

When the layer 8 is completed the coated substrate exists in a relatively stress free state with a dense, erosion resistant layer 8 over a low density, highly microcracked ceramic underlayer 4.

Figure 5:
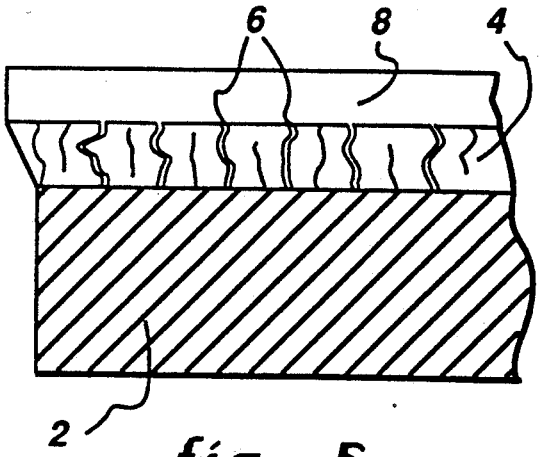
FIG. 5 is a schematic drawing of the compliant nature of the low density TBC layer after the substrate and the two TBC layers are cooled to room temperature, according to the present invention.

When the coated substrate is cooled to room temperature (~70° F.), the ceramic underlayer 4 can flex with respect to the hard ceramic layer 8 and substrate 2 (FIG. 5). In this way, thermal strains can be accommodated without the induction of high thermal residual stresses.

The part therefore meets the requirements placed on it while remaining relatively stress free. It, therefore, has desirable thermal and erosion properties and is unlikely to spall.

For the sake of simplicity only a two layer process has been described here, but more than two layers or an overall thickness of less than 35 mils might be appropriate to further enhance the stress relieving potential of the concept.

Once given the above disclosure, many other features, modifications or improvements will become apparent to the skilled artisan. Such features, modifications or improvements are, therefore, considered to be apart of this invention, the scope of which is to be determined by the following claims.

What is claimed is:

1. A method for producing thermal barrier coatings on a substrate having first and second sides, said method comprised of the steps of:

coating said first side of said substrate with a low density thermal barrier coating such that said coating has first and second sides and said first side of said coating is adjacent said first side of said substrate;

modifying said low density coating such that cracks form in said coating substantially perpendicular to said first and second sides of said coating; and coating said second side of said low density coating with a high density thermal barrier coating such that said high density coating has first and second sides and said first side of said high density coating is adjacent said second side of said low density coating.

2. The method, according to claim 1, wherein said step of coating with said low density coatings is further comprised of the step of:

spraying at room temperature.

3. The method, according to claim 1, wherein said step of coating with said high density coating is further comprised of the step of:

heating said substrate and said low density coating; and spraying said high density coating.

4. The method, according to claim 1, wherein said step of modifying said low density coating is further comprised of the step of:

heating said low density coating to approximately one-half of its service temperature.

* * * * *